US010267138B2

(12) United States Patent
Samuel et al.

(10) Patent No.: US 10,267,138 B2
(45) Date of Patent: Apr. 23, 2019

(54) PREDICTING TEMPERATURE-CYCLING-INDUCED DOWNHOLE TOOL FAILURE

(71) Applicant: Landmark Graphics Corporation, Houston, TX (US)

(72) Inventors: Robello Samuel, Cypress, TX (US); Aniket, Houston, TX (US); Serkan Dursun, Stafford, TX (US)

(73) Assignee: Landmark Graphics Corporation, Houston, TX (US)

( * ) Notice: Subject to any disclaimer, the term of this patent is extended or adjusted under 35 U.S.C. 154(b) by 23 days.

(21) Appl. No.: 15/509,060

(22) PCT Filed: Oct. 8, 2014

(86) PCT No.: PCT/US2014/059681
§ 371 (c)(1),
(2) Date: Mar. 6, 2017

(87) PCT Pub. No.: WO2016/057030
PCT Pub. Date: Apr. 14, 2016

(65) Prior Publication Data

US 2017/0284186 A1 Oct. 5, 2017

(51) Int. Cl.
*E21B 21/08* (2006.01)
*E21B 44/02* (2006.01)
(Continued)

(52) U.S. Cl.
CPC ..... *E21B 44/02* (2013.01); *E21B 21/00* (2013.01); *E21B 21/08* (2013.01); *E21B 47/065* (2013.01); *E21B 49/00* (2013.01); *E21B 47/18* (2013.01)

(58) Field of Classification Search
CPC ..... E21B 44/02
(Continued)

(56) References Cited

U.S. PATENT DOCUMENTS

2003/0168257 A1 9/2003 Aldred et al.
2007/0179766 A1* 8/2007 Cullick ..... E21B 43/00 703/10
(Continued)

FOREIGN PATENT DOCUMENTS

WO 2013126074 A1 8/2013

OTHER PUBLICATIONS

International Search Report, International Search Report and Written Opinion, International application No. PCT/US2014/059681, which is a PCT parent of the instant application, dated Jul. 6, 2015.
(Continued)

*Primary Examiner* — Taras P Bemko
(74) *Attorney, Agent, or Firm* — Howard L. Speight, PLLC

(57) ABSTRACT

One drilling method embodiment includes: obtaining a set of drilling parameters, possibly from a drilling plan; applying the set of drilling parameters to a physics-based model to obtain an estimated log of a downhole parameter such as temperature; and refining the estimated log using a data-driven model with a set of exogenous parameters. Temperature cycling and cumulative fatigue (or other measures of failure probability or remaining tool life) may be derived to predict tool failures, identify root causes of poor drilling performance, and determine corrective actions.

18 Claims, 4 Drawing Sheets

(51) Int. Cl.

| | |
|---|---|
| ***E21B 21/00*** | (2006.01) |
| ***E21B 47/06*** | (2012.01) |
| ***E21B 49/00*** | (2006.01) |
| *E21B 47/18* | (2012.01) |

(58) Field of Classification Search
USPC ..... 175/24
See application file for complete search history.

(56) References Cited

U.S. PATENT DOCUMENTS

| | | | | |
|---|---|---|---|---|
| 2008/0314585 | A1 | 12/2008 | Clark | |
| 2011/0247803 | A1 | 10/2011 | Rodney et al. | |
| 2013/0277115 | A1 | 10/2013 | Paulk | |
| 2014/0326449 | A1* | 11/2014 | Samuel | E21B 44/00 166/250.01 |

OTHER PUBLICATIONS

Kumar, Aniket, Samuel, Robello, Analytical Model to Predict the Effect of Pipe Friction on Downhole Fluid Temperatures, SPE Drilling & Completion, Oct. 2013, pp. 270-277, Asia Pacific Oil & Gas Conference and Exhibition, Jakarta, Indonesia.

* cited by examiner

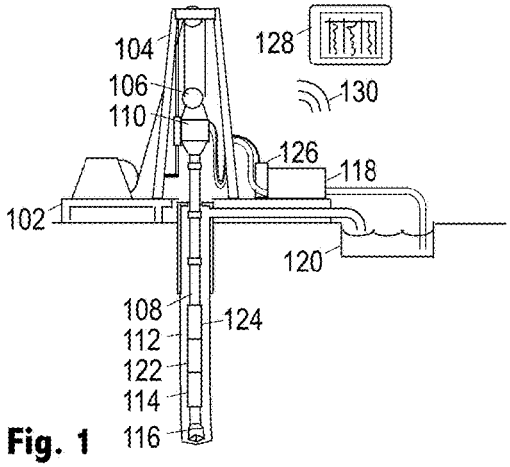
Fig. 1
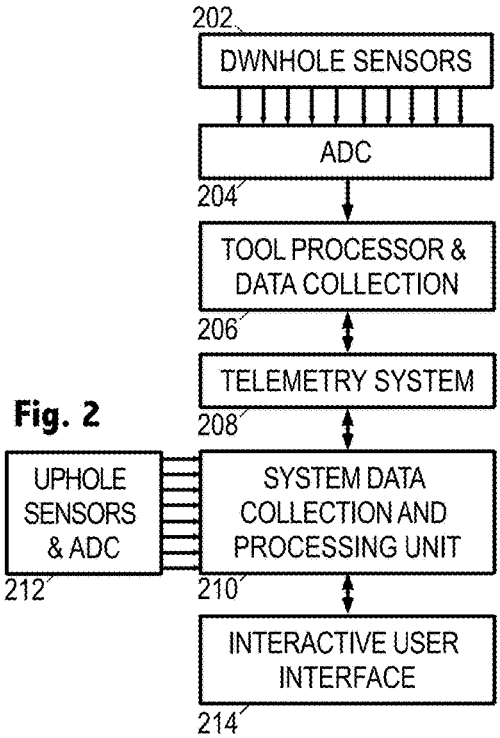
Fig. 2
Fig. 3
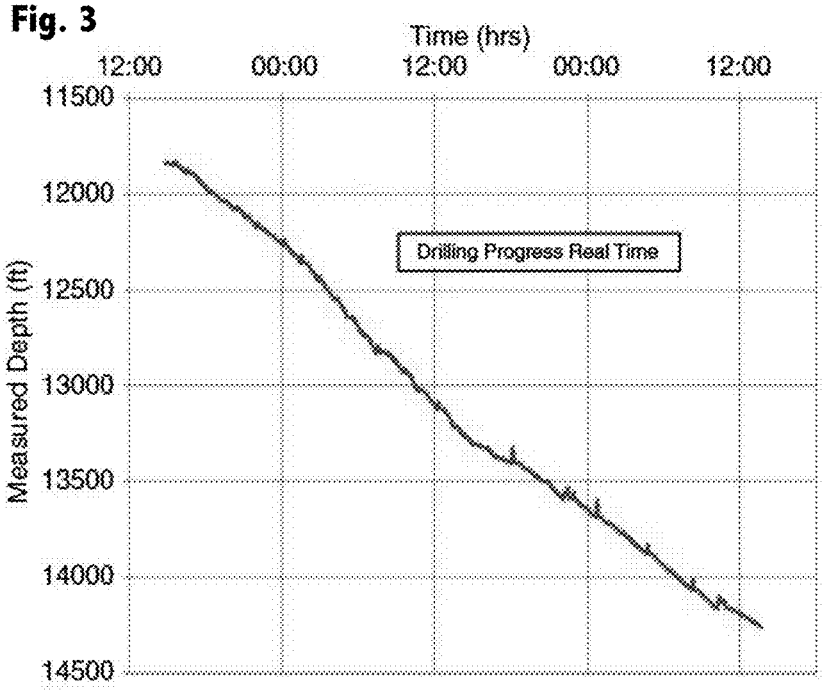

PREDICTING TEMPERATURE-CYCLING-INDUCED DOWNHOLE TOOL FAILURE

BACKGROUND

Oilfield operators demand a great quantity of information relating to the parameters and conditions encountered downhole. Such information typically includes characteristics of the earth formations traversed by the borehole, and data relating to the size and configuration of the borehole itself. The collection of information relating to conditions downhole, which commonly is referred to as "logging," can be performed in real time during the drilling operation using logging while drilling ("LWD") tools that are integrated into the drill string. For various reasons, these tools are preferably positioned near the bit where the drilling operation causes the downhole environment to be particularly hostile to electronic instrumentation and sensor operations. Tool failures, whether partial or complete, are all too common.

The data acquisition and control systems interface on the rig communicates with the LWD tools using one or more telemetry channels. The most commonly employed telemetry channels support data rates that are severely limited, forcing operators to choose among the available sensor measurements. Often, only the highest-priority measurements are communicated in "real-time" (in compressed form) and the rest are sent infrequently or stored for later retrieval, which may occur during pauses in the drilling process or perhaps be delayed until the drilling assembly is physically recovered from the borehole. Often, much of the data is discarded for lack of telemetry channel bandwidth and lack of adequate space in the downhole memory.

Thus many parameters of the downhole environment at any given time are unknown or poorly tracked. Impending tool failure detection and root cause diagnosis are issues that have not been adequately addressed, meaning that many downhole tool failures continue to be unexpected and "inexplicable".

BRIEF DESCRIPTION OF THE DRAWINGS

Accordingly, there are disclosed in the drawings and the following description systems and methods for monitoring and predicting temperature-cycling induced downhole tool failure events while drilling. In the drawings:

FIG. 1 shows an illustrative logging while drilling (LWD) environment.

FIG. 2 is a block diagram of an illustrative LWD system.

FIG. 3 is a graph showing an illustrative drilling position as a function of time.

Figure 4:
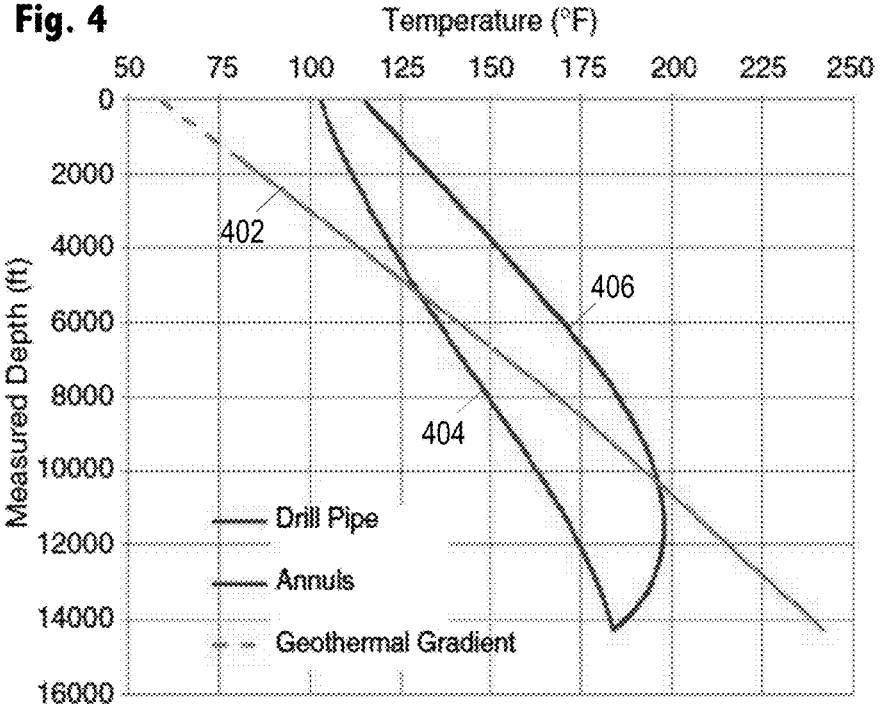
FIG. 4 is a graph showing an illustrative dependence of temperature on position.

It should be understood, however, that the specific embodiments given in the drawings and detailed description thereto do not limit the disclosure. On the contrary, they provide the foundation for one of ordinary skill to discern the alternative forms, equivalents, and modifications that are encompassed together with one or more of the given embodiments in the scope of the appended claims.

DETAILED DESCRIPTION

The disclosed methods and systems are best understood in the context of the larger systems in which they operate. Accordingly, FIG. 1 shows an illustrative logging while drilling (LWD) environment. A drilling platform 102 supports a derrick 104 having a traveling block 106 for raising and lowering a drill string 108. A top drive 110 supports and rotates the drill string 108 as it is lowered into a borehole 112. The rotating drill string 108 and/or a downhole motor assembly 114 rotates a drill bit 116. As the drill bit 116 rotates, it extends the borehole 112 through various subsurface formations. The downhole motor assembly 114 may include a rotary steerable system (RSS) that enables the drilling crew to steer the borehole along a desired path. A pump 118 circulates drilling fluid through a feed pipe to the top drive 110, downhole through the interior of drill string 108, through orifices in drill bit 116, back to the surface via the annulus around drill string 108, and into a retention pit 120. The drilling fluid transports cuttings from the borehole into the retention pit 120 and aids in maintaining the borehole integrity.

The drill bit 116 and downhole motor assembly 114 form just one portion of a bottom-hole assembly (BHA) that includes one or more drill collars (i.e., thick-walled steel pipe) to provide weight and rigidity to aid the drilling process. Some of these drill collars include built-in logging instruments to gather measurements of various drilling parameters such as position, orientation, weight-on-bit, rotation rate, torque, vibration, borehole diameter, downhole temperature and pressure, etc. The tool orientation may be specified in terms of a tool face angle (rotational orientation), an inclination angle (the slope), and compass direction, each of which can be derived from measurements by magnetometers, inclinometers, and/or accelerometers, though other sensor types such as gyroscopes may alternatively be used. In one specific embodiment, the tool includes a 3-axis fluxgate magnetometer and a 3-axis accelerometer. As is known in the art, the combination of those two sensor systems enables the measurement of the tool face angle, inclination angle, and compass direction. Such orientation measurements can be combined with gyroscopic or inertial measurements to accurately track tool position.

One or more LWD tools 122 may also be integrated into the BHA for measuring parameters of the formations being drilled through. As the drill bit 116 extends the borehole 112 through the subsurface formations, the LWD tools 122 rotate and collect measurements of such parameters as resistivity, density, porosity, acoustic wave speed, radioactivity, neutron or gamma ray attenuation, magnetic resonance decay rates, and indeed any physical parameter for which a measurement tool exists. A downhole controller associates the measurements with time and tool position and orientation to map the time and space dependence of the measurements. The measurements can be stored in internal memory and/or communicated to the surface, though as explained previously limits exist on the rate at which such communications can occur. A telemetry sub 124 may be included in the bottom-hole assembly to maintain the communications link with the surface. Mud pulse telemetry is one common telemetry technique for transferring tool measurements to a surface interface 126 and to receive commands from the surface interface, but other telemetry techniques can also be used. Typical telemetry data rates may vary from less than one bit per minute to several bits per second, usually far below the necessary bandwidth to communicate all of the raw measurement data to the surface in a timely fashion.

The surface interface 126 is further coupled to various sensors on and around the drilling platform to obtain measurements of drilling parameters from the surface equipment. Example drilling parameters include standpipe pressure and temperature, annular pressure and temperature, drilling fluid flow rates to and from the hole, drilling fluid density and/or heat capacity, hook load, rotations per minute, torque, deployed length of the drill string 108, and rate of penetration.

A processing unit, shown in FIG. 1 in the form of a tablet computer 128, communicates with surface interface 126 via a wired or wireless network communications link 130 and provides a graphical user interface (GUI) or other form of interactive interface that enables a user to provide commands and to receive (and optionally interact with) a visual representation of the acquired measurements. The measurements may be in log form, e.g., a graph of the measured parameters as a function of time and/or position along the borehole. The processing unit can take alternative forms, including a desktop computer, a laptop computer, an embedded processor, a cloud computer, a central processing center accessible via the internet, and combinations of the foregoing.

In addition to the uphole and downhole drilling parameters and measured formation parameters, the surface interface 126 or processing unit 128 may be further programmed with additional parameters regarding the drilling process, which may be entered manually or retrieved from a configuration file. Such additional parameters may include, for example, the specifications for the drill string tubulars, including wall material and thickness as well as stand lengths; the type and configuration of drill bit; the LWD tools; and the configuration of the BHA. The additional information may further include a desired borehole trajectory, an estimated geothermal gradient, typical pause lengths for connection makeups, logs from offset wells, pressure limits, flow rate limits, and any limits on other drilling parameters.

Thus the term "parameter" as used herein is a genus for the various species of parameters: uphole drilling parameters, downhole drilling parameters, formation parameters, and additional parameters. Synonyms include "attribute" and "characteristic", and each parameter has a value that may be set (e.g., a tubular wall material) or that may be measured (e.g., a flow rate), and in either case may or may not be expected to vary, e.g., as a function of time or position.

FIG. 2 is a function-block diagram of an illustrative LWD system. A set of downhole sensors 202, preferably but not necessarily including both drilling parameter sensors and formation parameter sensors, provides signals to a sampling block 204. The sampling block 204 digitizes the sensor signals for a downhole processor 206 that collects and stores the signal samples, either as raw data or as derived values obtained by the processor from the raw data. The derived values may, for example, include representations of the raw data, possibly in the form of statistics (e.g., averages and variances), function coefficients (e.g., the amplitude and speed of an acoustic waveform), the parameters of interest (e.g., the weight-on-bit rather than the voltage across the strain gauge), or compressed representations of the data.

A telemetry system 208 conveys at least some of the measured parameters to a processing system 210 at the surface, the uphole system 210 collecting, recording, and processing the measured parameters from downhole as well as from a set of sensors 212 on and around the rig. Processing system 210 may display the recorded and processed parameters in log form on an interactive user interface 214. The processing system 210 may further accept user inputs and commands and operate in response to such inputs to, e.g., transmit commands and configuration information via telemetry system 208 to the downhole processor 206. Such commands may alter the operation of the downhole tool, e.g., adjusting power to selected components to reduce power dissipation or to adjust fluid flows for cooling.

Though the various parameters operated on by the uphole processing system represent different characteristics of the formation and the drilling operation, it should be recognized that they are not, strictly speaking, linearly independent. For example, the temperature measured by downhole tools may correlate with: the deployed length of the drill string (pursuant to the geothermal gradient); with the rotation rate, hook load, and torque (pursuant to frictional work); and with the rate of penetration and fluid flow rates (pursuant to heat transfer phenomena). Additional correlations with other parameters, whether attributable to known or unknown causes, may be sought and exploited. Particularly when combined with geothermal trends or more sophisticated engineering models for predicting temperature dependence along the desired borehole trajectory, the information derivable from such correlations with uphole drilling parameters is expected to be sufficient for accurate, real-time tracking of downhole temperature.

Consider FIG. 3, which is a graph of an illustrative drilling position as a function of time. This parameter may be measured uphole as a deployed length of the drill string, but may also or alternatively be based on parameters measured by the navigation instruments incorporated in the BHA and transmitted to the uphole processing system 126, 210. (Though not apparent on this scale, there are periodic pauses for the addition of new stands to extend the drill string.) At any given depth, the temperature profile for the fluids in the borehole can be simulated or modeled analytically, based on physical principles.

Figure 5:
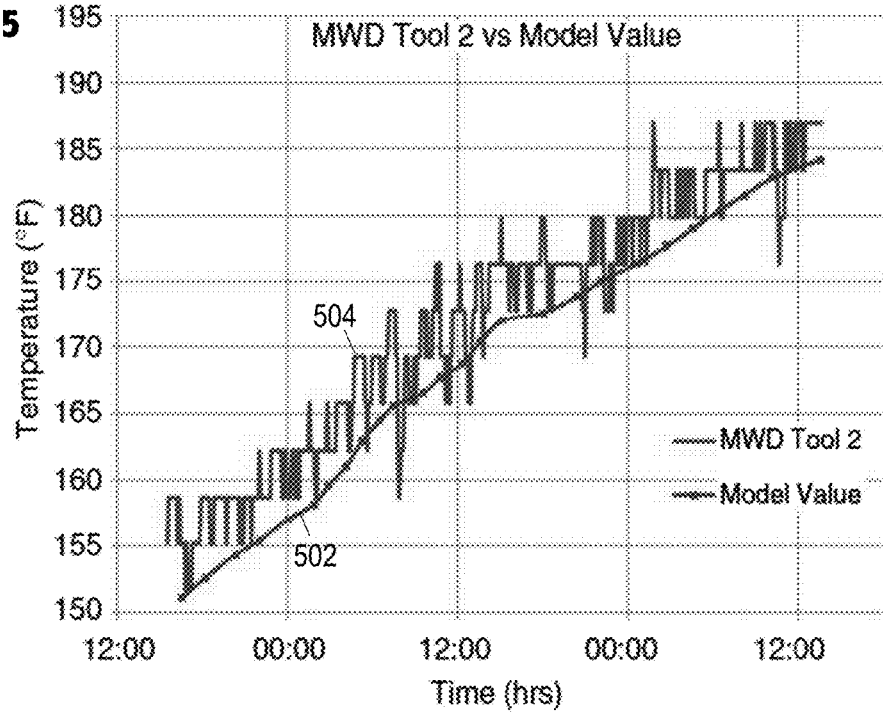
FIG. 5 is a graph comparing an estimated and a measured dependence of tool temperature on time.

FIG. 4 shows an illustrative example of an analytically-modeled temperature profile with the drill string at the final position in FIG. 3. Curve 402 shows the geothermal gradient of the formation, which is known from other sources and which influences the temperature profile of the borehole. Due to the flowing fluid, however, the temperature profile in the borehole deviates from this geothermal gradient. Curves 404 and 406 respectively show the temperature profiles for the fluid in the drillstring (elsewhere referred to as the temperature inside the pipe) and the fluid in the annulus, pursuant to the physics-based model analysis laid out by Kumar and Samuel, "Analytical Model to Predict the Effect of Pipe Friction on Downhole Fluid Temperatures", SPE 165934, Drilling & Completion, September 2013. Based on the measured position (FIG. 3) and given flow rate, the modeled BHA temperature as a function of time is shown as curve 502 in FIG. 5. For comparison, the measured BHA temperature is shown as curve 504. Though some of the error is due to quantization effects, most of it is attributable to other phenomena that are not included in the model and which are expected to correlate with other measured parameters, e.g., rotation rate, torque, measured flow, ROP, each of which may represent pauses in drilling activity and excess friction during drilling.

Figure 6:
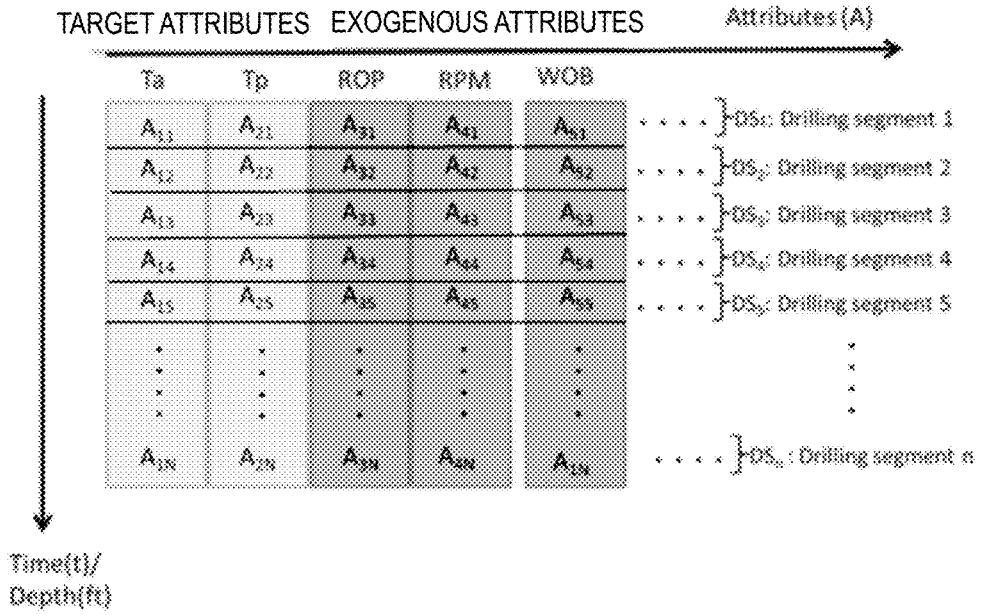
FIG. 6 is an table of illustrative attributes.

FIG. 6 is a table of illustrative parameters that may be acquired as a function of time or BHA position, each row corresponding to a different sampling time or position along the borehole. (As indicated by the labels on the right side of the figure, some implementations may groups multiple rows together to form sets that are associated with different position-based or time-based segments of the borehole or of the drilling process in general.) The columns of the table represent two sets of parameters—the first set is labeled as Target Attributes, and the second set is labeled as Exogenous Attributes.

The target attributes are those parameters that are predicted by the physics-based model from the available set of surface and downhole parameter measurements. In this case, the target attributes are the annular temperature (Ta) and the temperature of the fluid in the pipe (Tp) at the BHA position. The exogenous attributes are those parameters, whether measured by surface sensors or retrieved from downhole sensors, that are available for use in combination with the predictions of the physics-based model. These may include some or all of the measurements employed by the physics-based model to predict the target attributes, and may further include any additional measurements that are potentially correlated to the desired information and are available for consideration. In this particular example, the exogenous attributes include rate of penetration (ROP), revolutions per minute (RPM), and weight on bit (WOB). Hook load, standpipe pressure, and fluid flow rate are also specifically contemplated, as are any available or forecasted logs of formation properties such as gamma radiation, sonic velocity, and temperature.

Figure 7:
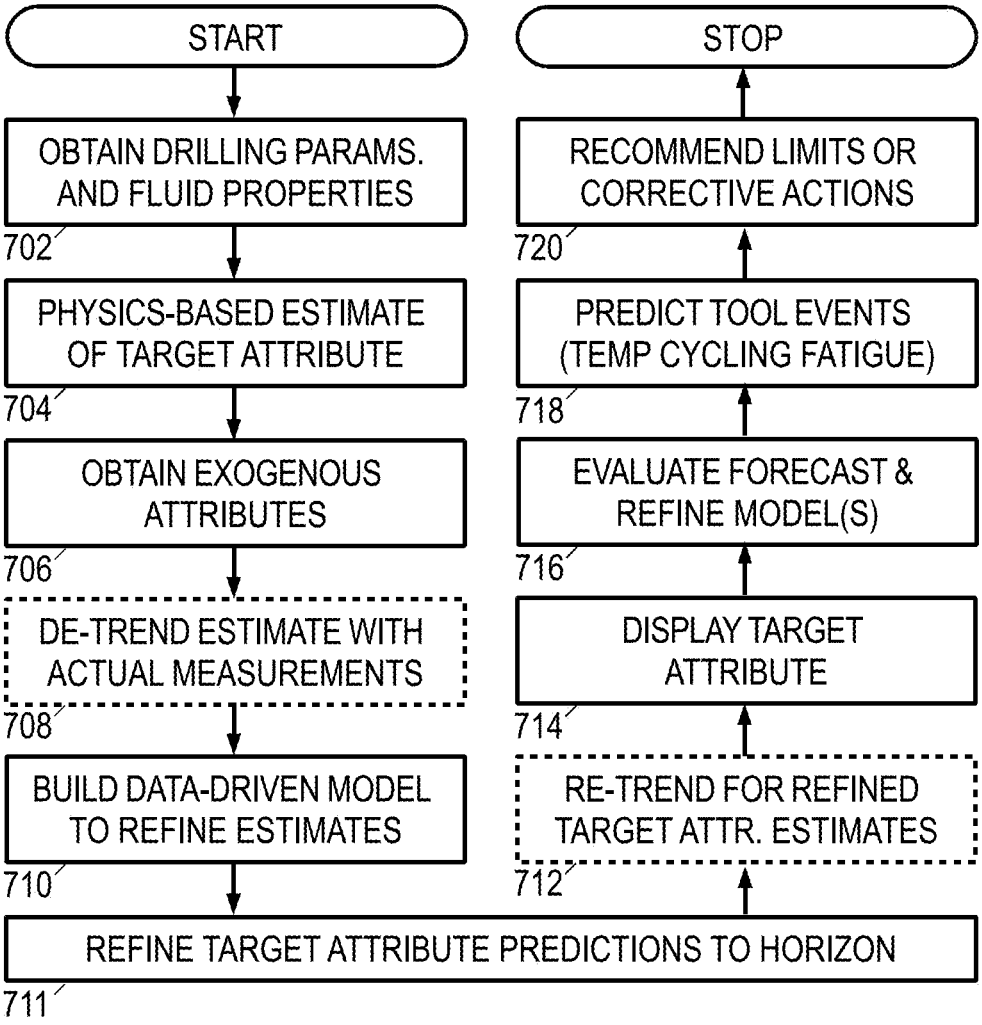
FIG. 7 is a flow diagram of an illustrative drilling method embodiment.

Based on the foregoing principles and observations, FIG. 7 presents a flow diagram of an illustrative first illustrative logging method which may be implemented by the surface interface 126 or the uphole processing unit 128, 210. In block 702, the system collects the available drilling parameters and properties of the drilling fluid. These parameters may be derived from sensors in an ongoing drilling operation, but may alternatively be derived from plans for a drilling operation. The drilling plan may be based on a volumetric model of the subsurface formations of interest, with a planned trajectory for the borehole, an anticipated geothermal gradient, the expected rock facies along the trajectory, the configuration for the bottomhole assembly (including bit type and dimensions), the nominal properties of the drilling fluid including flow rates, and the desired drilling rate, with typical make-up times and intervals.

In block 704, the system employs the collected drilling parameters in a physics-based model to provide an estimated log of the target parameter(s), such as annular temperature and in-pipe temperature as a function of time or depth. (Refer to the Kumar and Samuel reference for details of an illustrative physics-based model.) In block 706, the system takes the estimated logs of target parameters and augments the data with exogenous parameter logs. Such parameters may, but do not necessarily, include some or all of the parameters operated on by the physics-based model. FIG. 6 provides an example of the resulting set of parameter logs.

Note that the data collected in block 706 may in some cases include actual measurements of the target parameters, e.g., if being performed in real time during the drilling operation. Thus the system may be obtaining downhole temperature measurements via telemetry from the bottomhole assembly. If such actual measurements are available, then in optional block 708, the system may de-trend the estimated logs by subtracting the measured log of target parameters.

In block 710, the system trains a data-driven model for operating on the estimated logs of target parameters and any logs of exogenous parameters to produce a predicted log of target parameters that is more refined than the estimated logs. Such refinement may be possible because the data-driven model is able to account for omissions and approximations employed by the physics-based model. The training performed in block 710 is based on a comparison of target parameter predictions to target parameter measurements. This comparison may be performed in a segment-by-segment fashion, with the model derived from the measurements of a preceding drilling segment being employed for predicting target parameter values in the next drilling segment. Alternatively, the comparison may be performed dynamically to permit faster model adaptation.

In block 711, the system employs the data-driven model to make refined predictions of the target parameters as a function of time or position along the borehole trajectory. The system may extend the predictions out to a forecast horizon, which can similarly be expressed in terms of time or position. The data-driven model trained and employed in blocks 710-711 may be implemented in a variety of ways, the purpose in each case being to automatically extract and employ the correlations or other forms of information that may be hidden in the set of parameters. Among the suitable modeling techniques that may be implemented by the system are regression-based or auto-regressive forecasting models such as AR (auto-regression only), ARX (auto-regression exogenous), ARMA (auto-regression moving average), and ARMAX (auto-regression moving-average exogenous), and their non-linear counterparts NAR, NARX, NARMA, and NARMAX; and regression based forecasting models such as support vector machines (SVM) and neural networks. Regardless of the model implementation, their forecasting performance may be evaluated relative to the target parameter measurements on the basis of mean absolute error (MAE), relative absolute error (RAE), mean absolute percentage error (MAPE), mean square error (MSE), root mean square error (RMSE), root relative squared error (RRSE), direction accuracy (DAC—a net count of whether predictions are above or below measurements), Akaike information criterion (AIC), or the Bayesian information criterion (BIC), possibly combined with a complexity-based penalty to prevent over-fitting the data.

If the optional de-trending operation represented by block 708 is employed, block 711 yields refinements for the estimated logs rather than the refined predictions themselves, and accordingly in block 712 the system would combine these refinements with the estimated logs to produce the predicted logs of target parameters. Such de-trending may enable the data-driven model to better account for the inaccuracies of the physics-based model.

In block 714, the system displays the target parameters forecasted for future segments of the borehole, up to a selected forecasting horizon. In block 716, the system may compare previously-generated forecasts to actual measurement logs of the target parameters and, if the performance is determined to be inadequate, may initiate re-selection of the data-driven model implementation and/or re-training to improve the performance of the model. In addition to improving prediction accuracy, data driven models potentially reveal hidden relationships, enabling engineers to, e.g., determine impacts of specific exogenous parameters on the target parameter, possibly indicating previously unrecognized causes of tool failure.

In block 718, the system derives tool event predictions from the predicted logs of the target parameters. Specifically contemplated are a derivation of temperature cycling and cumulative stress fatigue, though other measures of remaining tool life or failure probability would also be suitable.

Figure 8A:
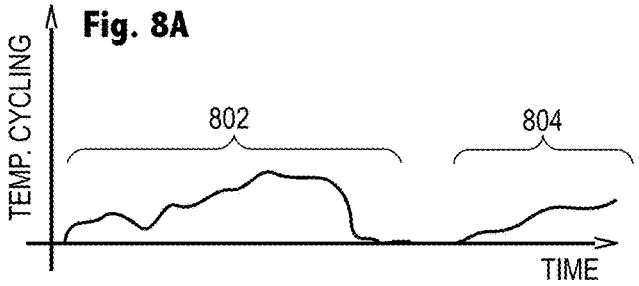
FIGS. 8*a*-8*b* are graphs showing predicted temperature cycling and fatigue as a function of time.
Figure 8B:
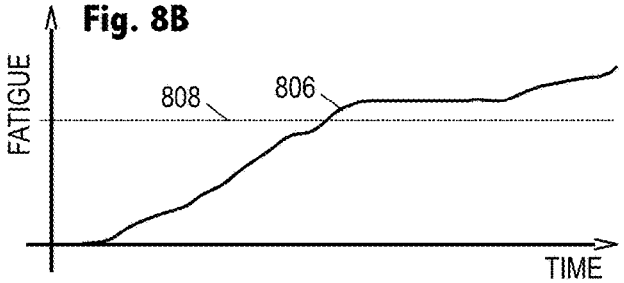

FIG. 8*a* is a graph of an illustrative temperature cycling log for a given downhole tool, which may extend over a time period that includes the history of tool since it was last serviced. The graph shows two periods 802, 804 of active temperature cycling that may be predicted for the given tool in accordance with a drilling plan. Such temperature cycling may be measured as an average (absolute value of) temporal derivative of a predicted log of downhole temperature. Such temperature cycling contributes to the predicted cumulative stress fatigue 806 shown in FIG. 8*b*. As indicated, the cumulative fatigue evolves in a generally non-decreasing fashion, eventually reaching and exceeding a threshold 808. The threshold may represent a level indicating when the tool should be serviced or replaced to minimize risks or costs associated with tool failure. Alternatively such a threshold crossing may instead be used as an indication of a likely root cause if poor drilling performance is observed, enabling corrective or mitigating actions to be taken until the root cause can be fixed.

In block 720 (FIG. 7), the predicted tool events or estimated event probabilities can be displayed and accompanied with feasible corrective actions or recommendations. For example, if the stress fatigue expected from the predicted temperature cycling exceeds a threshold, the system may recommend replacing or servicing a tool prior to the drilling of the next borehole segment. Alternatively, if permitted by the other drilling considerations, the system may recommend stricter limits on the flow rate of the drilling fluid to reduce temperature cycling.

The method of FIG. 7 contemplates application of the model during the drilling process itself (i.e., in "real time"). However, models derived based on the data obtained from one or more drilled boreholes may further be employed during the planning process for drilling new boreholes in the region. In such cases, the predicted target parameters are based on drilling parameters that are themselves estimates rather than measured values. Nevertheless, such predictions may be particularly helpful in securing availability of repair equipment and replacement tools in situations where risks of tool failure suggest the desirability of such precautions.

Among the embodiments disclosed herein are:

A: A drilling method that includes: obtaining a set of drilling parameters; applying the set of drilling parameters to a physics-based model to obtain an estimated log of a downhole parameter; and employing a data-driven model to produce a predicted log of said downhole parameter based at least in part on said estimated log.

B: A drilling system that includes: one or more downhole tools to be used as part of a drilling string to extend a borehole in accordance with a drilling plan; and a processing unit that derives a temperature cycling prediction for each of the one or more downhole tools based at least in part on the drilling plan.

Each of these embodiments may include one or more of the following features in any combination. Feature 1—comparing the predicted log to measurements of the downhole parameter and responsively updating the data-driven model. Feature 2—the set of drilling parameters is associated with a drilling plan that is modified based at least in part on the predicted log. The modified drilling plan may include at least one modified limit on at least one drilling parameter in said set. Feature 3—the downhole parameter includes a downhole temperature. Feature 4—the set of drilling parameters includes at least weight on bit, rotation rate, rate of penetration, and flow rate. Feature 5—the set of drilling parameters includes properties of a drilling fluid. Feature 6—the downhole parameter includes temperature cycling of a downhole tool. Feature 7—deriving a tool event forecast from the predicted log. The tool event forecast may include a cumulative stress fatigue exceeding a threshold and/or may include a tool failure probability exceeding a threshold. Feature 8—the data-driven model includes an autoregressive filter component. Feature 9—the data-driven model comprises a exogenous input filter component. The exogenous inputs may include at least one of the drilling parameters. Feature 10—the data-driven model is regression-based. Feature 11—as part of deriving the one or more temperature cycling predictions, the processing unit applies a physics-based model to a set of parameters associated with the drilling plan to obtain an estimated log of a downhole temperature, and operates on the estimated log using a data-driven model to produce the temperature cycling prediction. Feature 12—based at least in part on a temperature cycling prediction for a given tool among the one or more downhole tools, the processing unit recommends servicing or replacement of the given tool.

Numerous modifications and other variations will become apparent to those skilled in the art once the above disclosure is fully appreciated. It is intended that the following claims be interpreted to embrace all such variations and modifications where applicable.

What is claimed is:

1. A drilling method that comprises:

obtaining a set of drilling parameters associated with a drilling plan for a well;

applying the set of drilling parameters to a physics-based model to obtain an estimated log of a downhole parameter, wherein the downhole parameter is a temperature of a tool, wherein the estimated log of the downhole parameter is an estimated temperature of the tool versus depth in the well or versus time in the drilling plan in the well, and wherein the physics-based model accepts the set of drilling parameters as inputs and generates as an output, for each instance of inputs, a depth or time and a value of the downhole parameter to include in the estimated log; and employing a data-driven model to produce a predicted log of said downhole parameter based at least in part on said estimated log, wherein the predicted log of said downhole parameter is a predicted temperature of the tool versus depth in the well or versus time in the drilling plan in the well, and wherein the data-driven model accepts as inputs the estimated log and a log of an exogenous response that is not the temperature of the tool but that is correlated with the downhole parameter and generates as an output, for each instance of inputs, a depth or time and a value of the downhole parameter to include in the predicted log.

2. The method of claim 1, further comprising: comparing the predicted log to measurements of the downhole parameter and responsively updating the data-driven model.

3. The method of claim 1, wherein the method further comprises formulating a modified drilling plan based at least in part on the predicted log.

4. The method of claim 3, wherein the modified drilling plan includes at least one modified limit on at least one drilling parameter in said set.

5. The method of claim 1, wherein the exogenous response is selected from the group consisting of weight on bit, rotation rate, rate of penetration, and flow rate.

6. The method of claim 1, wherein the set of drilling parameters comprises properties of a drilling fluid.

7. The method of claim 1, further comprising: deriving a temperature cycling of the tool.

8. The method of claim 1, further comprising: deriving a tool event forecast from the predicted log.

9. The method of claim 8, wherein the tool event forecast comprises a cumulative stress fatigue exceeding a threshold.

10. The method of claim 8, wherein the tool event forecast comprises a tool failure probability exceeding a threshold.

11. The method of claim 1, wherein the predicted log is a function of position along a borehole trajectory, and said predicted log extends to a selected horizon distance beyond a current drilling tool position.

12. The method of claim 1, wherein the predicted log is a function of time, and wherein said predicted log extends to a selected horizon time beyond a current time.

13. The method of claim 1, wherein the data-driven model is an autoregressive forecasting model.

14. The method of claim 1, wherein the data-driven model is a regression-based forecasting model.

15. A drilling system to extend a borehole in accordance with a drilling plan, the drilling system comprising:

a drilling string comprising a downhole tool; and a processing unit that derives a temperature cycling prediction for the downhole tool by applying a physics-based model to a set of parameters associated with the drilling plan to obtain an estimated log of a downhole temperature of the downhole tool, and operates on the estimated log using a data-driven model to produce the temperature cycling prediction;

wherein the estimated log of the downhole temperature is an estimated downhole temperature of the downhole tool versus depth in a well or versus time in the drilling plan in the borehole, and wherein the physics-based model accepts the set of parameters associated with the drilling plan as inputs and generates as an output, for each instance of inputs, a depth or time and a value of the downhole temperature of the downhole tool to include in the estimated log; and wherein the predicted log of said downhole parameter is a predicted temperature of the downhole tool versus depth in the borehole or versus time in the drilling plan in the borehole, and wherein the data-driven model accepts as inputs the estimated log and a log of an exogenous response that is not the downhole temperature of the downhole tool but that is correlated with the downhole temperature of the downhole tool and generates as an output, for each instance of inputs, a depth or time and a value of the downhole temperature of the downhole tool to include in the predicted log.

16. The system of claim 15, wherein the data-driven model further operates on the set of parameters associated with the drilling plan.

17. The system of claim 15, wherein based at least in part on a temperature cycling prediction for the downhole tool, the processing unit recommends servicing or replacement of the downhole tool.

18. The system of claim 15, wherein based at least in part on a temperature cycling prediction for the downhole tool, the processing unit recommends limiting or modifying at least one parameter associated with the drilling plan.

* * * * *